United States Patent [19]

Gobel

[11] Patent Number: 4,964,226

[45] Date of Patent: Oct. 23, 1990

[54] HIGH TURNDOWN ROTARY DRYER FLIGHTS

[75] Inventor: Richard J. Gobel, Scappoose, Oreg.

[73] Assignee: Beloit Corporation, Beloit, Wis.

[21] Appl. No.: 418,421

[22] Filed: Oct. 6, 1989

[51] Int. Cl.[5] ..... F26B 11/02

[52] U.S. Cl. ..... 34/136; 241/91; 360/226; 34/137; 34/108; 432/118

[58] Field of Search ..... 34/10, 12, 19, 108, 34/136, 137, 141, 142, 135; 432/103, 106, 108, 111, 118; 241/91; 366/226

[56] References Cited

U.S. PATENT DOCUMENTS 3,245,154 4/1966 Bojner et al. ..... 34/136

4,376,343 3/1983 White et al. ..... 34/136

*Primary Examiner*—Henry C. Yuen

*Attorney, Agent, or Firm*—Dirk J. Veneman; Raymond W. Campbell

[57] ABSTRACT

A dryer drum for drying bulk material including a rotating drum having an inlet for material to be dried at one end and an outlet for dried material at the other end, a center shaft extending therethrough, vanes mounted on the shaft circumferentially spaced from each other and axially spaced along the shaft, the vanes having a first panel extending substantially in a radial plane parallel to the axis of the shaft, a second panel attached to the first panel and facing in a downstream direction and a third panel attached to the second panel; wherein the bulk material to be dried moves in sliding movement over the panels and is mechanically conveyed toward the dryer inlet.

21 Claims, 3 Drawing Sheets

FIG. 10
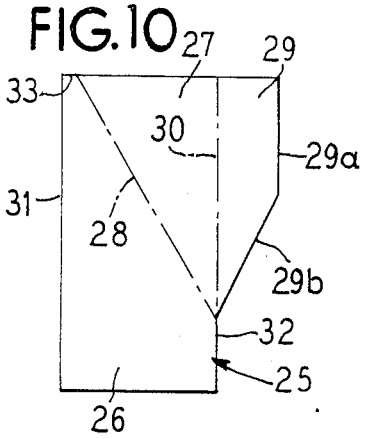
FIG. 9
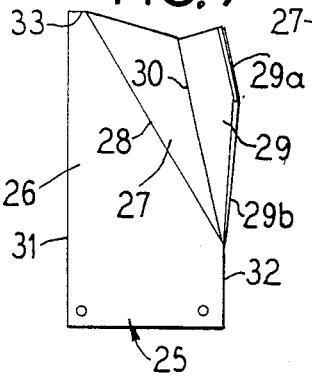
FIG. 8
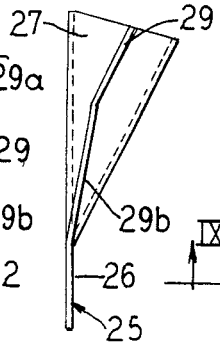
FIG. 7
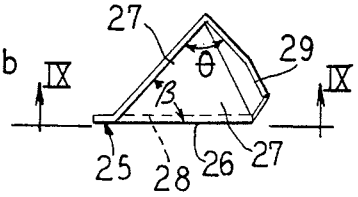
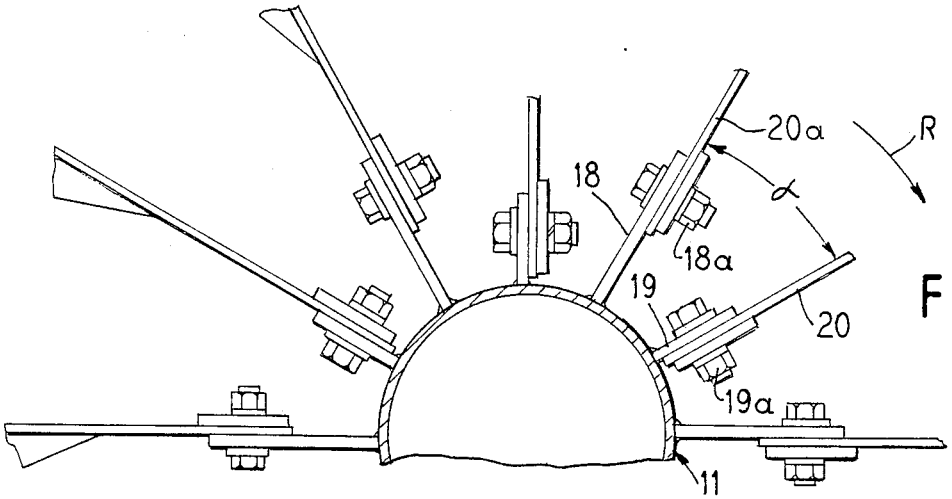
FIG. 5
FIG. 6
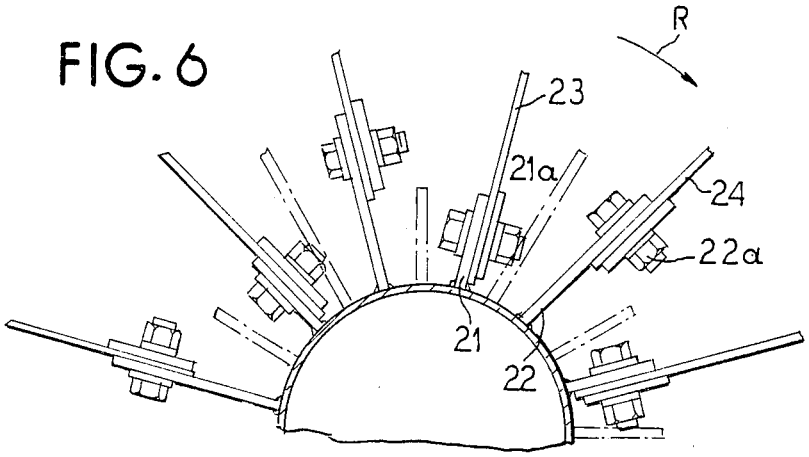

HIGH TURNDOWN ROTARY DRYER FLIGHTS

BACKGROUND OF THE INVENTION

The invention relates to improvements in dryers, and more particularly to a rotary dryer of the type which may be used for drying bulk material.

More particularly, the invention relates to dryers of the type which may be used in papermaking plants for drying hog fuel or bagasse with waste heat and direct fired dryers used for difficult to dry materials such as pulp mill sludge. The interest in drying systems for drying materials to be used as fuel results from the fact that dry fuel increases boiler efficiency and fuel BTU value. In the case of sludge, drying is beneficial in preparing the wet material as fuel or to substantially reduce its bulk, thereby reducing or eliminating costly landfill requirements. If drying of fuel is done in the boiler, much of the energy of combustion which could be used to generate steam is consumed by the drying process of incoming fuel. Because boilers are inefficient dryers, the effect on performance is dramatic in that efficiency declines substantially where the fuel must be dried within the boiler. In the case of sludge, drying in the boiler is extremely disruptive to the boiler operation.

In the boiler, wet fuels require large amounts of excess air to sustain combustion. The excess air, combined with the water vapor generated during drying reduces boiler efficiency and furnace temperature. The colder furnace produces less steam and more particulate emissions as unburned fuel passes up the stack.

Drying fuel results in more BTU's per pound of fuel as well as an increased boiler efficiency. Drying also allows the effective control of fuel moisture content as the moisture varies by season and with the composition of the raw material. The consistency of the fuel also contributes to more efficient and predictable boiler performance.

Fuel dryers have been used heretofore which are heated by waste heat and by direct firing, but the efficient and effective transfer of heat from the hot gases to the wet material varies greatly depending on the material properties and on the dryer loading.

It is accordingly an object of the present invention to provide an improved dryer such as may be used for drying hog fuel, sludge or bagasse with waste heat and by furnace direct firing wherein a unique and improved transfer of heat from the hot gases to the wet material is accomplished.

A further object of the invention is to provide a rotary dryer wherein the contents are tumbled or moved in a unique manner so as to increase the efficiency, capacity and effectiveness of heat transfer to the material even at low feed rates.

A further object of the invention is to provide an improved flight system within a rotary dryer wherein panels are provided arranged so that improved heat transfer results through controlling gas swirl and mixing, and wherein flights are provided having metal surfaces which effectively increase heat transfer through conduction.

Another object of the present invention is to provide an improved rotary drum center flight design which has a significant return effect on material passing through the dryer to significantly counteract the gas flow forces increasing retention time and drying efficiency on difficult to dry materials such as sludge.

Features of the Invention

The present invention provides a rotary drum with a center shaft extending axially in a downstream direction through the drum. Flights are supported on the shaft, spaced both circumferentially and axially on the shaft. The flights have panels bent or configured in a unique arrangement to provide an even dispersion of the material throughout the dryer into the gas stream which is directed through the dryer. Effective material dispersion contributes to uniform heat transfer, promoting efficient moisture evaporation.

The form of the flights provides a means for mechanically returning material towards the dryer inlet with a high degree of effectiveness. The return of material toward the dryer inlet counteracts the forces of gas flow through the dryer which tend to carry the material toward the dryer outlet. Return of the material toward the dryer inlet increases material retention time in the dryer resulting in improved heat transfer and higher dryer capacities. The flights ensure that adequate material is gathered to provide proper dispersion of the material by the outer shell flights.

The flights within the drum preferably have metal surfaces which allow material to rest on the heated metal for longer periods than conventional dryers. This increases heat transfer through conduction, which is a substantial aid to drying.

The center flights according to the present invention have a first panel extending radially outwardly from the shaft, a second panel extending from the first panel downstream edge and being angled to provide a surface facing radially inwardly toward the shaft and facing upstream, and a third triangularly shaped panel extending from a downstream edge of the second panel and having a surface facing the downstream surface of the second panel. The flights are arranged in arrays around the center section to eliminate straight through paths for gases flowing through the dryer. Material entrained in the gases impinge on plates of the flights stalling in movement and sliding toward the core of the dryer.

The arrangement and configuration of flights have been discovered to have an ability to dry particles of varying size and materials which, heretofore, were difficult to dry to a uniform moisture content. The wetter and more dense particles remain in the dryer longer than the less moist or less dense particles. The result is that the small, easily dried particles pass through the dryer more quickly than the larger more difficult to dry particles. Larger particles remain in the dryer until they have reached an acceptably low moisture content.

Other objects, advantages and features will become more apparent with the teaching of the principles of the invention in connection with the disclosure of the preferred embodiment in the specification, claims and drawings, in which:

DESCRIPTION OF THE DRAWINGS

FIG. 5 is a fragmentary vertical sectional view taken substantially along line V—V of FIG. 3;

FIG. 6 is a fragmentary sectional view taken substantially along line VI—VI of FIG. 3;

FIG. 7 is a radial end view of a flight taken substantially along line VII—VII of FIG. 3;

FIG. 8 is an axial elevational view of a flight taken substantially along VIII—VIII of FIG. 3;

FIG. 9 is an elevational view taken in the direction of line IX—IX of FIG. 7, illustrating the construction of the flights; and FIG. 10 is a plan view illustrating a section of sheet metal prior to its being bent into a flight of the present invention.

DESCRIPTION OF THE PREFERRED EMBODIMENT

Figure 1:
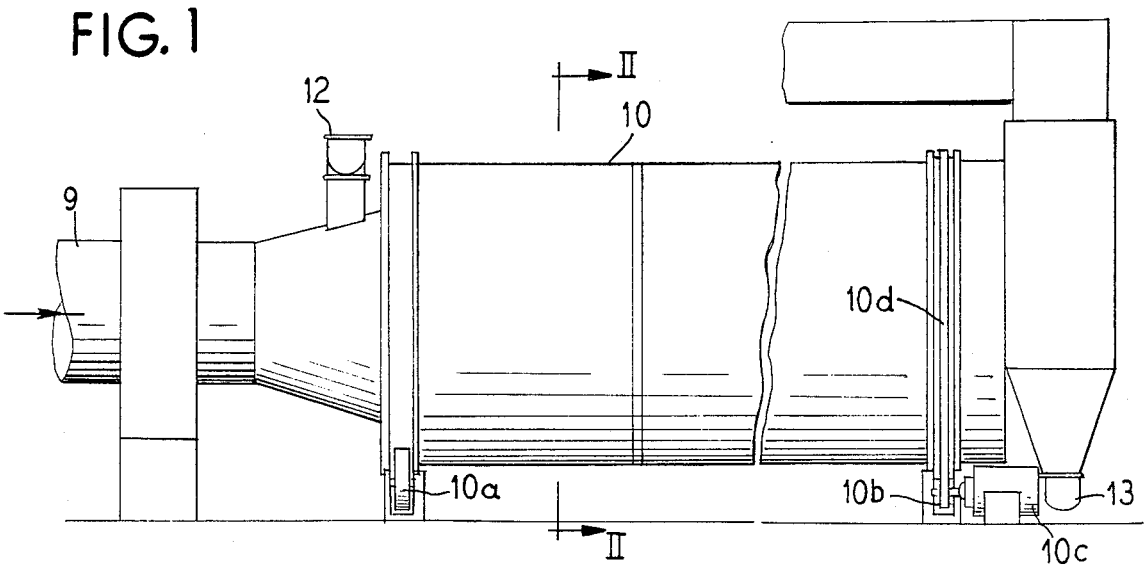
FIG. 1 is a side-elevational view of a dryer drum for drying bulk material.

FIG. 1 illustrates a dryer having a rotary drum 10 mounted for rotation on trunion wheels 10*a* and 10*b* with a driving motor 10*c* arranged to drive the drum in rotation through a drive chain 10*d* which engages teeth on the drum. Mounted coaxially within the drum is a center shaft 11 supporting flights, such as 16 and 17 which rotate with the drum.

Within the outer periphery of the drum are flights 18*a* which are triangularly shaped and mounted at their apex to the inner surface of the drum to project inwardly. The blades are angled or bent slightly, to cause the bulk material being processed to move axially toward the inlet end of the drum. It should be recognized that the drum flights shown are merely examples of suitable flights, and the center flights of the present invention can be used with other types of drum flights.

The drum has an inlet 12 for material to be dried. The drum is also provided with a dried material outlet 13. Heat is introduced into the drum at a hot gas inlet 9. The source of hot gases can be waste heat from other processes or direct fired heat from a burner or the like. A relatively strong current flow is established such that the material introduced at the inlet 12, although not held in suspension by the air flow, is at least influenced forwardly as the material is tumbled in the dryer.

The flights such as 16 and 17 within the drum are arranged to cause the wet bulk material which is to be dried to move in a pattern for the maximum drying effect and optimum passage of heated gases therethrough. Also, the flights are so constructed that, as the drum rotates, the material moves sequentially in an upstream direction toward the inlet 12 counteractive to the pneumatic conveying effects from the hot gases flowing through the dryer. The counteractive effect increases residency time in the dryer but does not fully overcome the pneumatic conveying effect, and the material eventually moves through the outlet 13. While passing through the dryer, the material is carried with maximum contact by the surface of the flights which are heated by the hot gases flowing through the dryer. Therefore, the drying of the material is further enhanced by the transfer of heat by conduction from the surface of the flights to the material being dried.

Figure 2:
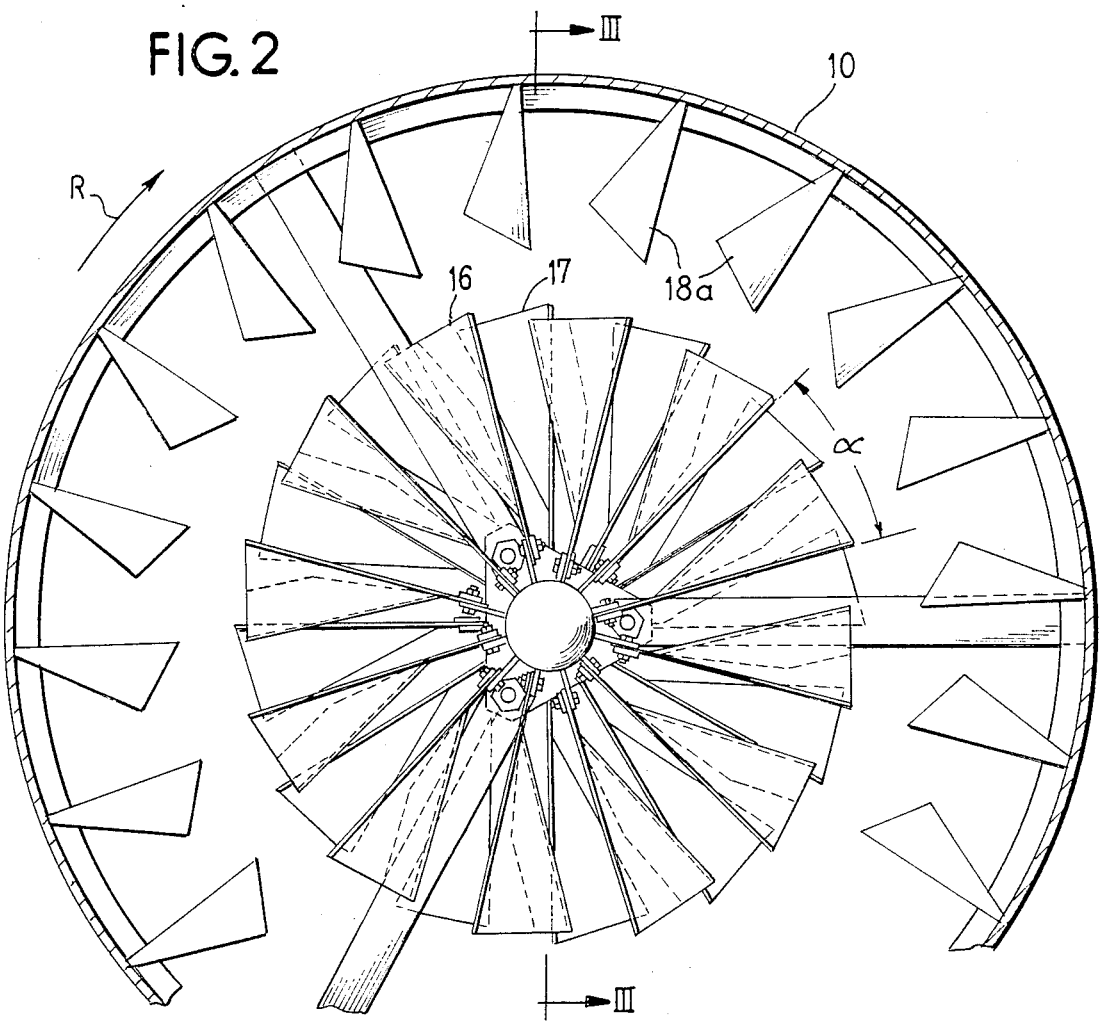
FIG. 2 is an enlarged vertical sectional view taken substantially along line II—II of FIG. 1.
Figure 3:
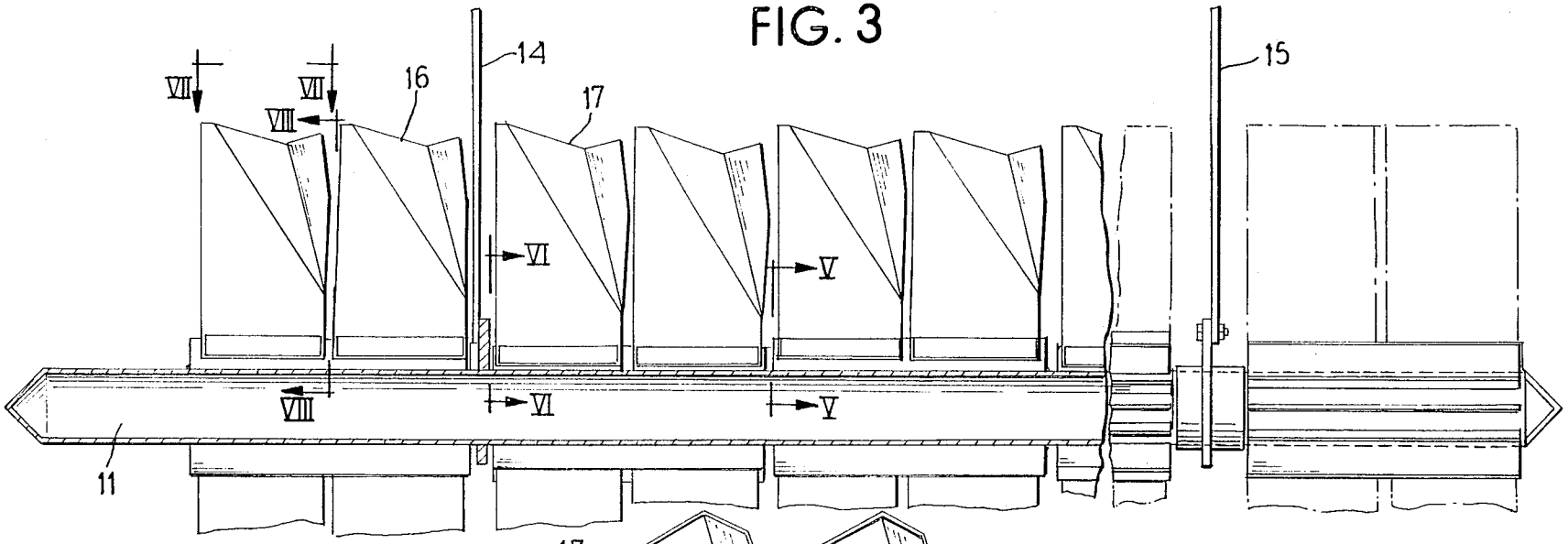
FIG. 3 is a partial sectional view taken substantially along III—III of FIG. 2, showing internal flights constructed and operating in accordance with the principles of the present invention.
Figure 4:
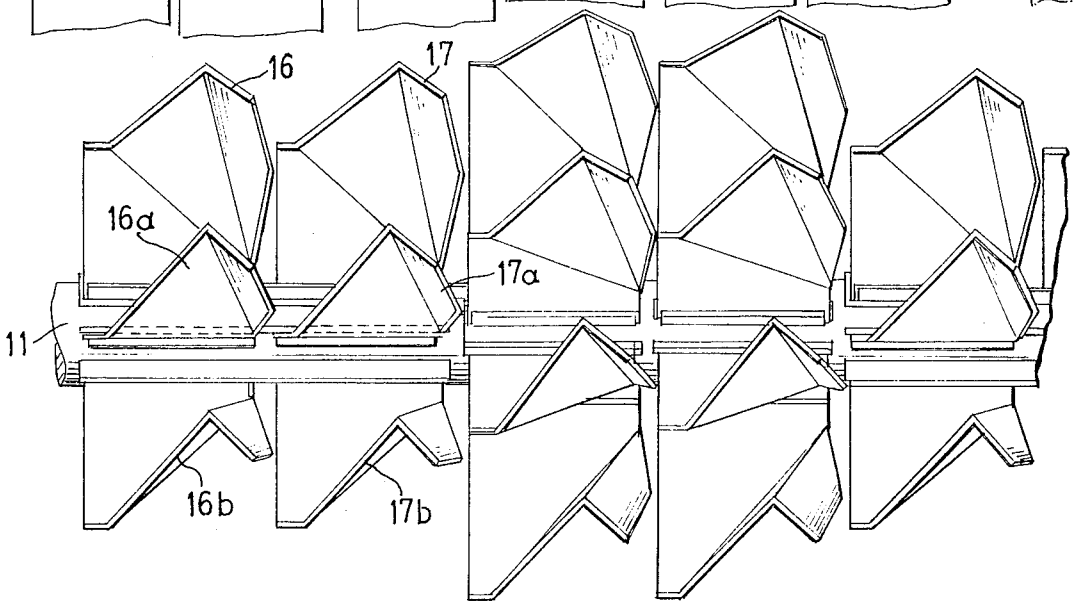
FIG. 4 is a fragmentary perspective view of the flights within the dryer drum.

As illustrated in FIGS. 2–4, the center flights are arranged circumferentially around the shaft 11 as indicated by the flights 16, 16*a*, and 16*b*. Groups of flights are also spaced axially along the shaft as illustrated by two sets of flights designated generally by the numerals 16 and 17, with the flights in the group designated by 17 including individual flights 17, 17*a*, and 17*b*. As illustrated in FIGS. 2 and 5, the flights are spaced from each other circumferentially by an angle $\alpha$ which is selected based on characteristics of the material handled and the desired results.

The shaft 11 is hollow tubular in form and has a plurality of radially projecting bosses such as 18 and 19, FIG. 5 and as shown at 21 and 22 in FIG. 6. As illustrated in FIG. 5, flights 20 and 20*a* are bolted to the bosses by bolts 18*a* and 19*a*. FIG. 6 illustrates the next sequential set of flights by the flights 23 and 24 which are secured to bosses 21 and 22 by bolts 21*a* and 22*a*. In a preferred arrangement, each successive set of flights are staggered circumferentially. Therefore, flight 24 as shown in FIG. 6 will be located between or intermediate flights 19 and 20.

The individual flights preferably are constructed of sheet metal bent to form different panels, although the panels may be formed by being welded to each other.

As illustrated in FIG. 10, which shows a flight 25, as a piece of flat metal prior to the necessary bending and formation. The flight has an upstream edge 31 and a downstream edge 32, and when bent to the form illustrated in FIGS. 7, 8, and 9, forms a panel area 26 along which the material to be dried slides. The flight is secured so that the panel area 26 extends axially in a plane passing through the axis of the support shaft 11.

At an edge of the first panel 26 is a second panel 27. The panel 27 is formed by bending the panel along a bend line 28 which extends angularly between edges 31 and 32. The second panel 27 has the surface which shows in FIG. 9 facing in a downstream direction. Rotation of the shaft will be clockwise as shown by the arrowed lines labelled R in FIGS. 2, 5, and 6 so that the downstream surface of the second panel 27 will engage the material being dried and cause the material to slide down onto the surface of the first panel 26, after sliding on the downstream surface of the panel 27.

Connected to the second panel 27 is a third panel 29. This panel is formed by bending along the bend line 30 shown in FIG. 10, which is substantially colinear with edge 32. The third panel 29 is bent in a direction so it faces in a substantially upstream direction with a surface of the third panel 29 facing the downstream facing surface of the second panel. The relative positions of the three panels will cause the material to have prolonged drying contact with the heated surfaces of the panels, and to be directed upstream, counter to the pneumatic conveying effects of the air flow.

Material collected in the crotch area between center flights slides along the backside of the surface 26 as the flight rotates from a substantially horizontal position to a substantially vertical and downwardly disposed position (i.e. from a 3 O'clock position to a 6 O'clock position as shown in FIG. 5). During this action, the material is further exposed to surface area contact against the hot dryer flights but, more importantly, the material is mechanically conveyed or shifted upstream by a distance the width of the flight. This provides an effective returning action directing material toward the inlet, which increases the dwell or residency time, and bunches or concentrates material during periods of light dryer loading to properly fill the shell flights.

In a preferred construction, the bend line 28 between the first panel 26 and the second panel 27 extends from adjacent the rear edge 31 but spaced therefrom a minimal distance from the edge 31 along a distal edge 33 of the panel and proceeds inwardly at an angle extending toward the axis of the shaft, and the bend line terminates at the forward edge 32 of the panel 26.

The bend line 30 is substantially radial, but inclined slightly rearwardly in an outward direction relative to the flow direction of the material through the drum.

The first panel 26 has the largest area. The second panel 27 has an area smaller than the first panel, and the third panel 29 has a area smaller than the second panel.

The second panel 27 is preferably bent at an angle relative to the first panel 26 of about 45° as indicated by the angle $\beta$ in FIG. 7.

The third panel 29 is bent relative to the second panel 27 of an angle $\theta$ preferably of about 90°.

The second panel 27 is triangular in shape. The third panel is of a trapezoid shape. A radial outer portion of the third panel 29 has a leading straight edge **29*a* which initially is parallel to the lead edge of the first panel, as shown in FIG. 8. The inner portion of the third panel 29 angles inwardly at 29*b* to terminate in an apex with the bend lines 28 and 30** joining each of the panels to each other.

In operation, material to be dried enters the drum at 12, FIG. 1, and passes through the rotating drum tumbled and spread and dried in sliding and dispersing contact with the sequential flights, such as 16 and 17. The drum flights **18*a* collect the material in the bottom portions of the dryer and, as the drum rotates, the drum flights 18*a* direct the material toward the rotor center flights. Conversely, the rotor flights 16, 17 collect material in the upper portion of the drum and, as the drum rotates, discharge the material in the bottom portion of the drum towards the outer shell. Thus, the material is effectively cascaded between the inner and outer flights as the drum rotates. The inner flights 16 and 17** are such that they turn back the material as it passes through, against the flow of heated drying air. The result is an even dispersion of material across the entire dryer cross section.

The relative position of the three panels of each flight is such that it encourages heat transfer by conduction due to contact with the flights as well as encouraging and causing dispersion and contact and retention in the drum while the material is still wet. When the material being dried becomes dry, it loses the weight of moisture, and it flows readily toward the discharge 13, ensuring that the material leaving through the discharge will be uniformly dry. A more efficient, more effective drying operation has been accomplished with increased absorption of BTU's in the material being dried and a more effective use of waste heat has been accomplished.

In some cases, it is advantageous to alternate the high turndown flights of the present invention with more conventional flights. This alternation can be in groups or series as necessary.

I claim as my invention:

1. A dryer drum for drying bulk material, comprising in combination:

an elongate drum having an inlet for receiving material to be dried and having a material outlet with the material advancing axially downstream through the drum;

means for delivering heat to the contents of the drum;

a central supporting shaft extending axially within the drum;

a plurality of center flights mounted at spaced locations on the shaft;

said center flights having a first panel extending outwardly from the shaft lying in an axial plane of the shaft, said first panel having a radially outer edge including at least a segment which extends generally outwardly from the shaft in a direction from the downstream edge toward the upstream edge of the first panel;

said center flights having a second panel extending from said first panel radially outer edge and angled with respect to said first panel to have a first surface facing radially inwardly toward the shaft and facing upstream, and a second surface facing radially outwardly from the shaft and facing downstream; and said center flights having a third panel extending from a downstream edge of said second panel and having a surface facing the downstream facing surface of said second panel.

2. A dryer drum for drying bulk material constructed in accordance with claim 1:

wherein each of said panels are planar portions having flat surfaces on both sides.

3. A dryer drum for drying bulk material constructed in accordance with claim 1:

wherein said first panel is bolted to the shaft.

4. A dryer drum for drying bulk material constructed in accordance with claim 1:

wherein said panels are of one piece attached to each other along bend lines.

5. A dryer drum for drying bulk material constructed in accordance with claim 1:

wherein said first and second panels join at an angle of about 45° therebetween.

6. A dryer drum for drying bulk material constructed in accordance with claim 1:

wherein said second and third panels join at an angle of about 90° therebetween.

7. A dryer drum for drying bulk material constructed in accordance with claim 1:

wherein said first and second panels join at an angle of about 45° therebetween and said second and third panels join at an angle of about 90° therebetween.

8. A dryer drum for drying bulk material constructed in accordance with claim 1:

wherein said center flights are circumferentially spaced around the shaft.

9. A dryer drum for drying bulk material constructed in accordance with claim 1:

wherein said said center flights are axially spaced along the shaft.

10. A dryer drum for drying bulk material constructed in accordance with claim 1:

wherein said center flights are formed of sheet metal.

11. A dryer drum for drying bulk material constructed in accordance with claim 1:

wherein said center flights are axially spaced along the shaft and different flights are of different radial size.

12. A dryer drum for drying bulk material constructed in accordance with claim 1:

including drum flights mounted within the outer periphery of the drum.

13. A dryer drum for drying bulk material constructed in accordance with claim 12:

wherein said drum flights are triangularly shaped with their apex extending outwardly and mounted at an angle to the axis of the shaft.

14. A dryer drum for drying bulk material, comprising in combination:

rotary drum having an inlet for receiving material to be dried and a dried material outlet with the material moving axially downstream within the drum from the inlet to the outlet;

a central supporting shaft extending axially within the drum;

a plurality of center flights mounted at axially spaced locations on the shaft;

said center flights having a first panel extending radially outwardly from the shaft and mounted thereon lying substantially in an axial plane of the shaft;

a second panel connected to the first panel at an angle thereto with the location of mounting extending in a straight line from the radially outer edge of the first panel inwardly at an angle progressing in a downstream direction;

and a third panel mounted on a downstream edge of the second panel along a line extending substantially radially from the axis of the shaft.

15. A dryer drum for drying bulk material constructed in accordance with claim 14:

wherein said second panel has a smaller surface area than the first panel.

16. A dryer drum for drying bulk material constructed in accordance with claim 14:

wherein said third panel has a smaller surface area than the second panel.

17. A center flight for a center shaft in a dryer drum for drying bulk material, in which the drum and the center shaft rotate about a longitudinal axis of the drum and shaft, said center flight comprising:

first, second and third panels each being of substantially flat, plate-like construction, and being disposed at angles relative to each other;

said first panel being adapted for attachment to the center shaft along a connecting edge oriented substantially axially along the shaft, said first panel including a relatively longer upstream edge and a relatively shorter downstream edge;

said second panel being connected to said first panel along a common edge with said first panel, said common edge extending from a radially outer edge of said first panel to said downstream edge of said first panel, said second panel being angularly disposed angularly rearwardly from said first panel in the direction of rotation of said shaft; and said third panel being connected to said second panel along a common edge with said second panel, said third panel being disposed generally angularly forwardly from said second panel in the direction of rotation of said shaft.

18. A center flight for a center shaft in a dryer drum for drying bulk material as defined in claim 17:

wherein said outer edge of said first panel includes a portion substantially parallel to said connecting edge of said first panel, and said common edge between said first and second panels is spaced from said upstream edge of said first panel along said parallel edge.

19. A center flight for a center shaft in a dryer drum for drying bulk material as defined in claim 17:

wherein said second panel is angled rearwardly from said first panel at about 45° from the plane of said first panel.

20. A center flight for a center shaft in a dryer drum for drying bulk material as defined in claim 17:

wherein said third panel and said second panel define therebetween an angle of approximately 90°.

21. A center flight for a center shaft in a dryer drum for drying bulk material as defined in claim 19:

wherein said third panel and said second panel define therebetween an angle of approximately 90°.

* * * * *